US007926312B2

(12) United States Patent
Kim et al.

(10) Patent No.: US 7,926,312 B2
(45) Date of Patent: Apr. 19, 2011

(54) WASHING MACHINE HAVING DAMPER-SUPPORTER

(75) Inventors: Sung-Ryong Kim, Incheon (KR); Sung-Min Kim, Seoul (KR); Kyung-Seop Hong, Incheon (KR); Gwan-Ryong Park, Seoul (KR); Seung-Chul Park, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 672 days.

(21) Appl. No.: 11/507,520

(22) Filed: Aug. 22, 2006

(65) Prior Publication Data

US 2007/0044519 A1 Mar. 1, 2007

(30) Foreign Application Priority Data

Aug. 26, 2005 (KR) ..... 10-2005-0079074

(51) Int. Cl.
*D06F 37/22* (2006.01)

(52) U.S. Cl. ..... 68/23.1; 68/24; 68/140

(58) Field of Classification Search ..... 68/23.1, 68/23.3, 24, 58, 140
See application file for complete search history.

(56) References Cited

U.S. PATENT DOCUMENTS

| | | | | | |
|---|---|---|---|---|---|
| 3,090,586 | A | * | 5/1963 | Schwegler et al. | 248/567 |
| 4,819,460 | A | * | 4/1989 | Obradovic | 68/23.7 |
| 5,249,440 | A | * | 10/1993 | Hossfield et al. | 68/23.3 |
| 5,257,516 | A | * | 11/1993 | Hossfield | 68/23.3 |
| 5,570,597 | A | * | 11/1996 | Bongini et al. | 68/17 R |
| 5,711,171 | A | * | 1/1998 | Uhlin | 68/4 |
| 2004/0025545 | A1 | * | 2/2004 | Chang | 68/23.1 |
| 2004/0244436 | A1 | | 12/2004 | Park et al. | |

FOREIGN PATENT DOCUMENTS

| | | | | |
|---|---|---|---|---|
| DE | 11 38 370 | B | | 10/1962 |
| FR | 2 411 914 | A | | 7/1979 |
| GB | 1 155 671 | A | | 6/1969 |
| GB | 1 520 383 | A | | 8/1978 |
| GB | 2182353 | A | * | 5/1987 |
| KR | 10-20040013994 | A | | 2/2004 |
| SU | 1 647 058 | A1 | | 5/1991 |

* cited by examiner

*Primary Examiner* — Joseph L Perrin
(74) *Attorney, Agent, or Firm* — McKenna Long & Aldridge LLP

(57) ABSTRACT

A washing machine having a damper-supporter, comprises: an outer case having a receiving space therein; a tub installed in the outer case; a damper having one end connected to the tub so as to perform a relative motion; and a damper-supporter spaced from the outer case so as to be vibration-isolated therefrom, for supporting another end of the damper. Accordingly, vibration and noise can be reduced by preventing vibration of the tub from being transmitted to the outer case through the damper.

6 Claims, 14 Drawing Sheets

WASHING MACHINE HAVING DAMPER-SUPPORTER

RELATED APPLICATION

The present disclosure relates to subject matter contained in priority Korean Application No. 10-2005-0079074, filed on Aug. 26, 2005, which is herein expressly incorporated by reference in its entirety.

BACKGROUND OF THE INVENTION

1. Field of the Invention

The present invention relates to a washing machine having a damper-supporter, and more particularly, to a washing machine having a damper-supporter capable of preventing vibration of a tub from being transmitted to an outer case through a damper.

2. Description of the Background Art

Generally, a washing machine comprises an outer case having a receiving space therein, a tub received in the outer case, and a washing tub rotatably installed in the tub. The tub is provided with a damper for reducing vibration generated when the washing tub is driven.

As shown in FIGS. 1 and 2, the related art washing machine comprises an outer case 10 having a receiving space therein, a tub 30 installed in the outer case 10, a washing tub 40 rotatably installed in the tub 30, and a supporting spring 51 and a damper 53 for respectively supporting the tub 30 at upper and lower sides of the tub 30. The damper 53 is constructed in three so as to support the tub 30 at three points.

The outer case 10 includes a base 11 arranged at a lower side and having a rectangular plate shape, and a cabinet 21 arranged at an upper side of the base 11 and forming a receiving space of a rectangular parallelepiped shape together with the base 11. A spring supporting portion 23 connected to an upper end of the supporting spring 51 is formed at an inner upper portion of the cabinet 21.

A leg 18 for supporting the base 11 from a floor surface is installed at each corner of the base 11. The leg 18 has a bar shape, and is provided with a male screw portion 19 at an outer surface thereof. A foot portion 20 contacting the floor surface is formed at a lower end of the leg 18. A female screw portion 13 screw-coupled to the male screw portion 19 is formed at the base 11. A plurality of damper coupling portions 15 are formed below the base 11 with facing to each other. A lower end of each damper 53 is coupled to each damper coupling portion 15 by a coupling member 35 such as a bolt, etc.

The tub 30 has a cylindrical shape having one opened side. The washing tub 40 is rotatably installed in the tub 30. The washing tub 40 has a cylindrical shape having one opened side, and is provided with a plurality of dehydration holes 41 penetratingly formed at a circumferential surface thereof. A plurality of lifts 43 for upwardly moving laundry are provided in the washing tub 40.

A spring connecting portion 31 connected to a lower end of the supporting spring 51 is formed at an outer upper portion of the tub 30. A damper coupling portion 33 for coupling the damper 53 is formed at an outer lower portion of the tub 30. An upper end of the damper 53 of which lower end is connected to the base 11 is coupled to each damper coupling portion 33 by a coupling member 35 such as a bolt, etc.

However, in the related art washing machine, when the washing tub 40 is driven, vibration of the tub 30 is transmitted to the base 11 through the damper 53 and the damper coupling portions 33 and 15. Accordingly, the base 11 and the cabinet 21 coupled to each other are vibrated, resulting in position deviation, a short lifespan, and a mal-operation of inner components. Accordingly, the washing machine has a degraded reliability, and causes noise.

SUMMARY OF THE INVENTION

Therefore, an object of the present invention is to provide a washing machine having a damper-supporter capable of reducing vibration and noise by preventing vibration of a tub from being transmitted to an outer case through a damper.

To achieve these and other advantages and in accordance with the purpose of the present invention, as embodied and broadly described herein, there is provided a washing machine having a damper-supporter, comprising: an outer case having a receiving space therein; a tub installed in the outer case; a damper having one end connected to the tub so as to perform a relative motion; and a damper-supporter spaced from the outer case so as to be vibration-isolated therefrom, for supporting another end of the damper.

According to another aspect of the present invention, there is provided a washing machine having a damper supporter, comprising: an outer case having a receiving space therein; a plurality of legs for supporting the outer case; a tub installed in the outer case; a supporter connected to the plurality of legs and installed to be spaced from the outer case; and a damper having one end connected to the tub and another end connected to the supporter.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, a washing machine having a damper-supporter according to the present invention will be explained in more detail.

Figure 1:
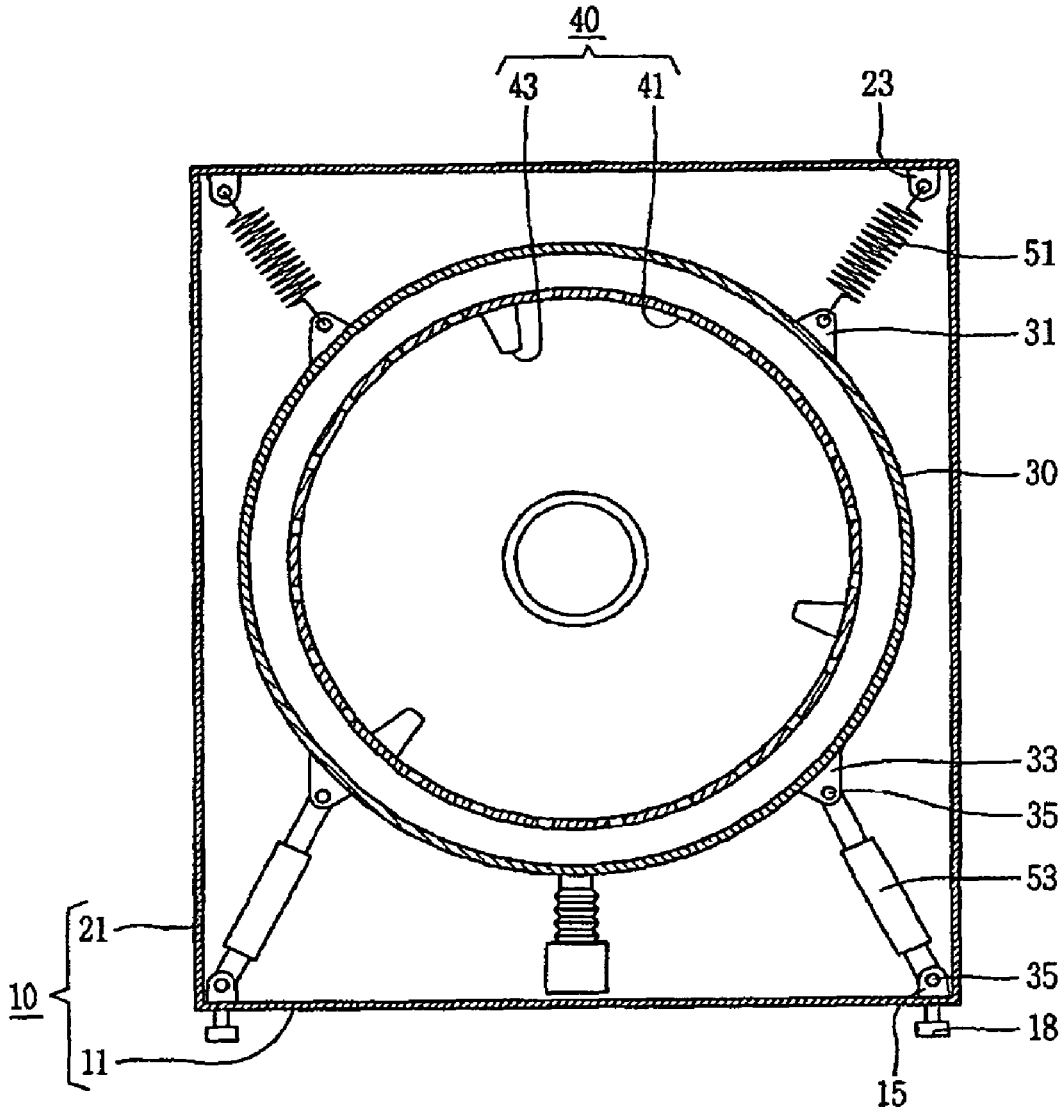
FIG. 1 RELATED ART
FIG. 1 is a sectional view showing a washing machine in accordance with the related art.
Figure 2:
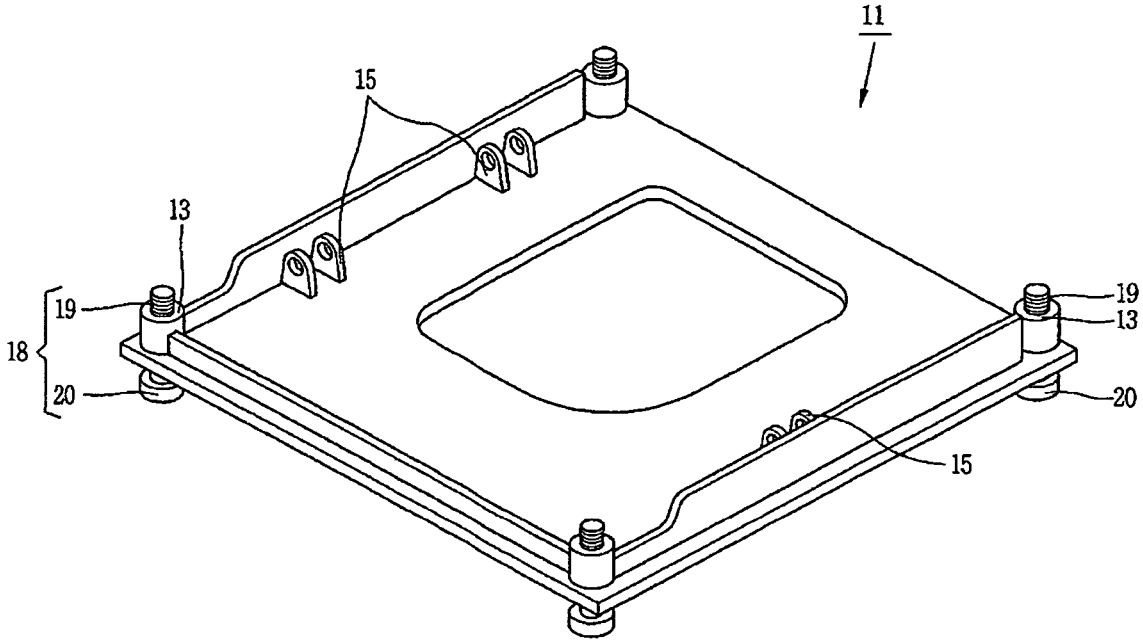
FIG. 2 RELATED ART
FIG. 2 is a perspective, view showing a base of the washing machine of FIG. 1.
Figure 3:
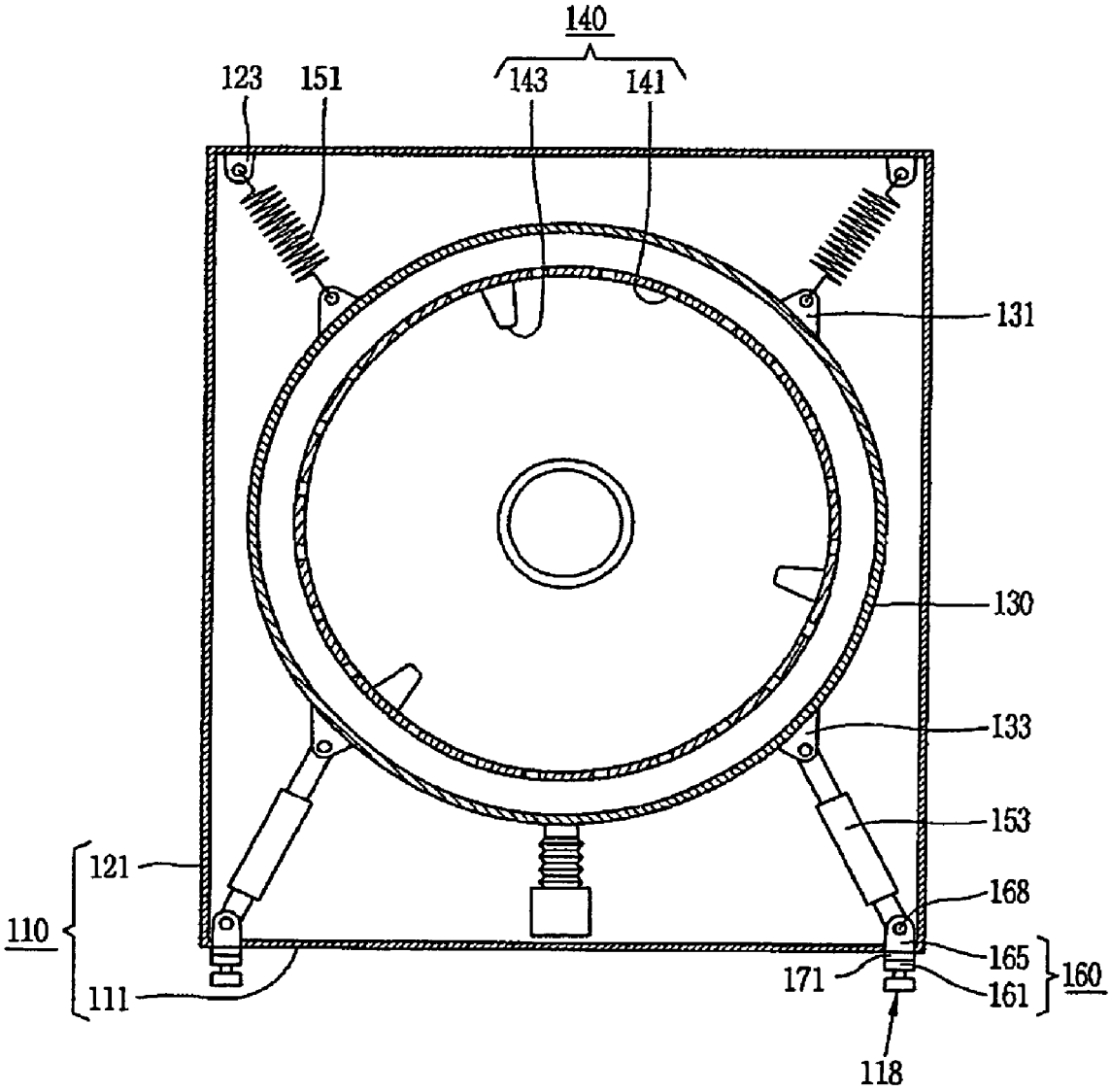
FIG. 3 is a sectional view showing a washing machine having a damper-supporter according to a first embodiment of the present invention.
Figure 4:
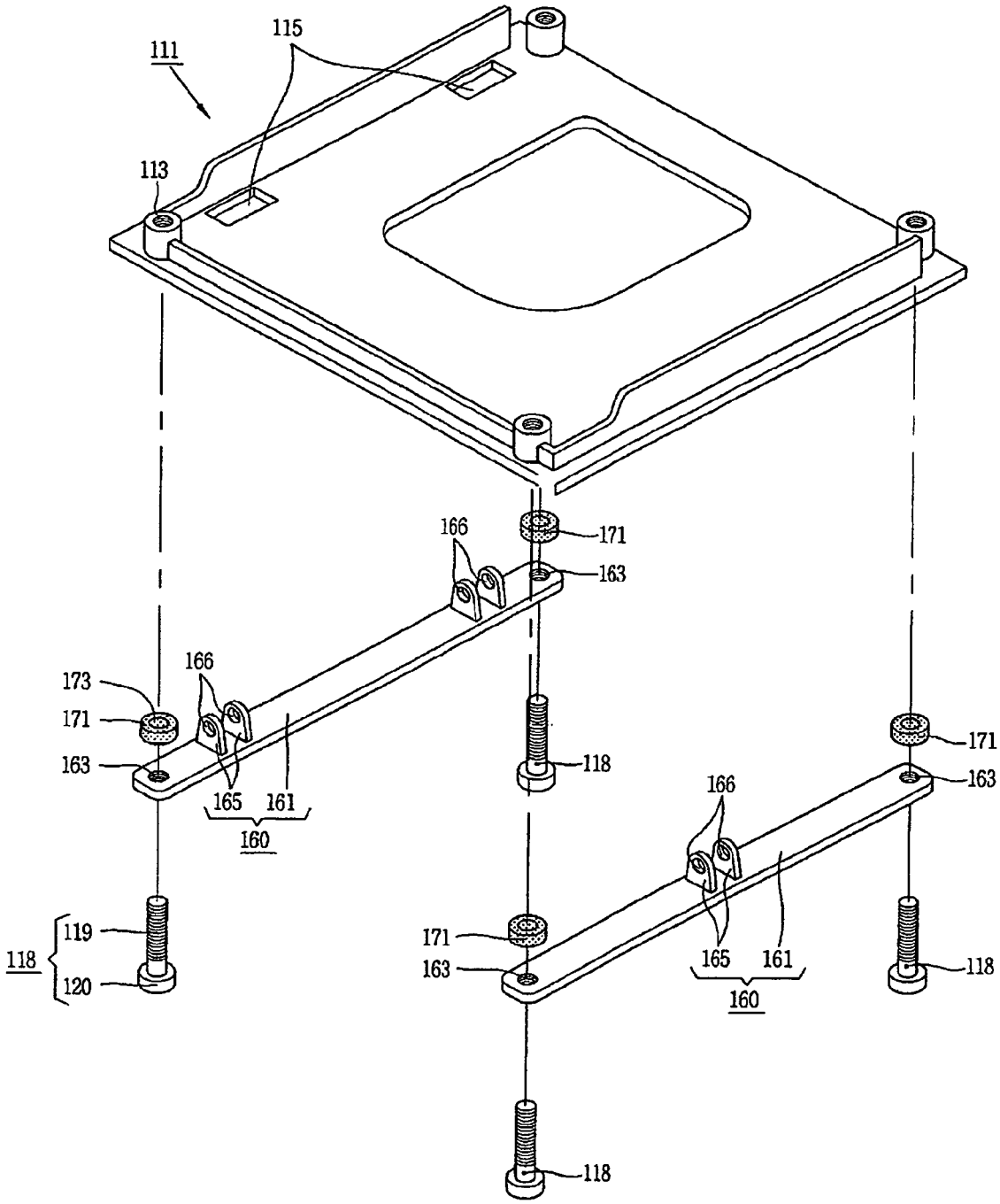
FIG. 4 is a perspective view showing a state prior to, a coupling between a base and a damper-supporter of FIG. 3.
Figure 5:
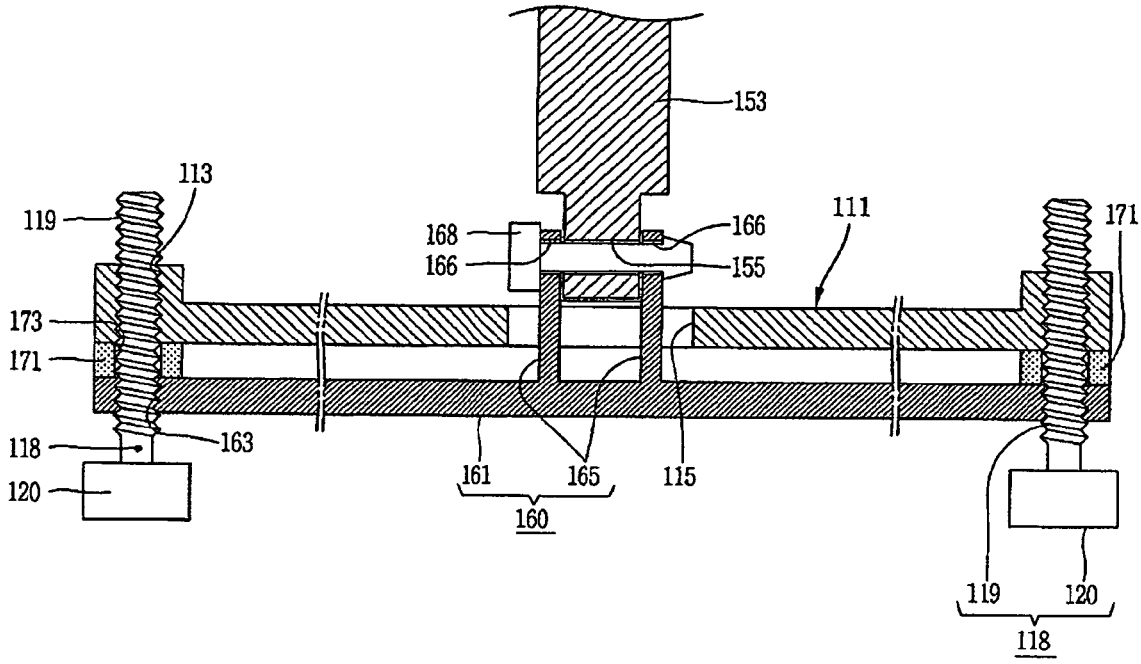
FIG. 5 is a sectional view showing a coupling state between the base and the damper-supporter of FIG. 4.

FIG. 3 is a sectional view showing a washing machine having a damper-supporter according to a first embodiment of the present invention, FIG. 4 is a perspective view showing a state prior to a coupling between a base and a damper-supporter of FIG. 3, and FIG. 5 is a sectional view showing a coupling state between the base and the damper-supporter of FIG. 4. As shown, a washing machine having a damper-supporter according to a first embodiment of the present invention comprises an outer case 110 having a receiving space therein; a tub 130 installed in the outer case 110; a damper 153 having one end connected to the tub 130; and a damper-supporter 160 spaced from the outer case 110 so as to be vibration-isolated from the outer case, for supporting another end of the damper 153.

The outer case 110 has a rectangular parallelepiped shape, and is provided with the tub 130 for receiving washing water therein. The tub 130 has a cylindrical shape having one opened side. The tub 130 is supported in the outer case 110 by a supporting spring 151 and the damper 153. A washing tub 140 is rotatably installed in the tub 130. A plurality of dehydration holes 141 are penetratingly formed at a circumferential surface of the washing tub 140. A plurality of lifts 143 inwardly protruding and spacing from one another in a circumferential direction are provided in the washing tub 140.

The outer case 110 includes a base 111 having a rectangular plate shape, and a cabinet 121 arranged at an upper side of the base 111 and forming a receiving space of a rectangular parallelepiped shape together with the base 111. A spring supporting portion 123 connected to an upper end of the supporting spring 151 is formed at an inner upper portion of the cabinet 121.

The damper 153 is provided with a frictional force, etc. at the time of being expanded and contracted. When the tub 130 is vibrated, the damper 153 is expanded and contracted thus to provide a resistance to the vibration of the tub 130 thereby to reduce the vibration of the tub 130.

A spring connecting portion 131 connected to a lower end of the supporting spring 151 is formed at an outer upper portion of the tub 130. A damper coupling portion 133 for coupling an upper end of the damper 153 is formed at an outer lower portion of the tub 130.

A female screw portion 113 for screw-coupling a leg 118 is formed at each corner of the base 111. The leg 118 is provided with a male screw portion 119 at an outer surface thereof, and is provided with a foot portion 120 contacting the floor surface at a lower end thereof. The foot portion 120 is formed of a rubber, etc.

A damper-supporter 160 for supporting a lower end of the damper 153 is arranged below the base 111 with facing to each other. The damper-supporter 160 comprises a supporter 161 arranged outside the outer case 110 with a spacing distance from the outer case 110, and a damper connection portion 165 protruding from the supporter 161 and inserted into the outer case 110 without contacting the outer case 110 thus to be connected to the damper 153.

Through holes 115 for inserting the damper connection portions 165 are penetratingly formed at the base 111. Each through hole 115 is formed to have a size enough not to contact the damper connection portion 165 when the washing machine is normally operated with consideration of a displacement of a lower end of the damper 153 when the tub 130 is vibrated due to driving of the washing tub 140.

The supporter 161 has an intensity enough to support the tub 130 having a maximum load, and has a long plate shape having a length corresponding to a width of the base 111 in back and forth directions. A female screw portion 163 screw-coupled to the leg 118 are formed at both ends of the supporter 161.

The number and position of the damper connection portions 165 formed at the supporter 161 correspond to the number and position of the dampers 153 coupled to the tub 130. Coupling holes 166 and 155 for inserting a coupling member 168 are respectively formed at the damper connection portion 165 and the damper 153. A mount member 171 for supporting the supporter 161 with a spacing distance from the base 111 is provided between the supporter 161 and the base 111. The mount member 171 is formed of an elastic member such as a rubber, etc. so as to prevent vibration from being transmitted between the supporter 161 and the base 111. A leg passing hole 173 for passing the leg 118 is formed in the middle of each mount member 171.

Hereinafter, an operation of the washing machine having a damper-supporter according to the present invention will be explained. When the washing tub 140 is rotated during a washing operation, a rinsing operation, and a dehydrating operation, the tub 130 connected to the washing tub 140 is vibrated with a frequency corresponding to an rpm of the washing tub 140. Herein, since the damper connection portion 165 connected to a lower end of the damper 153 is spaced from an inner surface of the through hole 115, vibration of the damper 153 is prevented from being transmitted to the base 111. Under a state that the damper-supporter 160 is provided with the mount member 171 at both ends thereof, vibration of the damper 153 is prevented from being transmitted to the base 111 by a spring operation of the supporter 161 due to its own elasticity and an elastic force of the mount member 171. Accordingly, vibration and noise of the outer case 110 are reduced.

Figure 6:
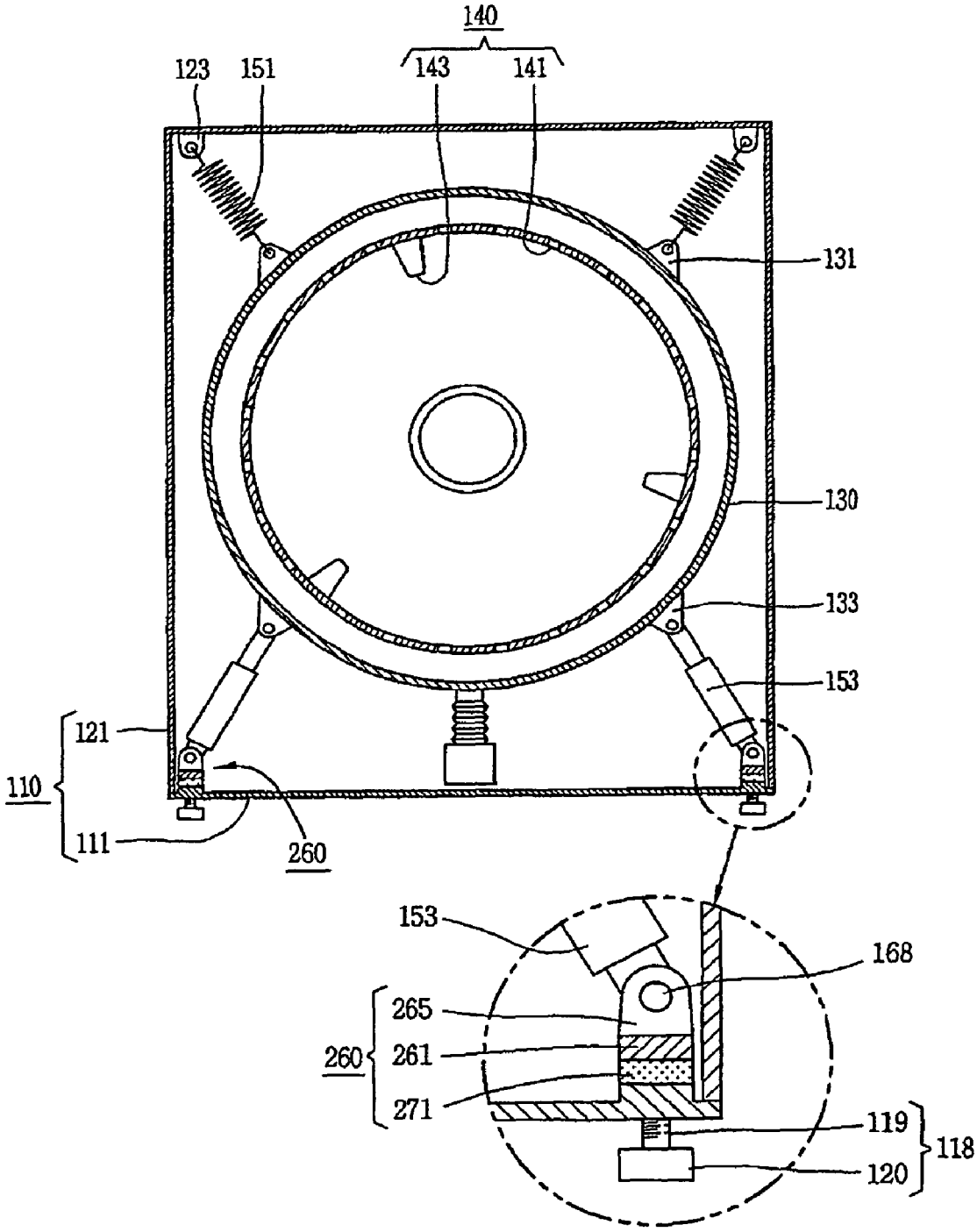
FIG. 6 is a sectional view showing a washing machine having a damper-supporter according to a second embodiment of the present invention.
Figure 7:
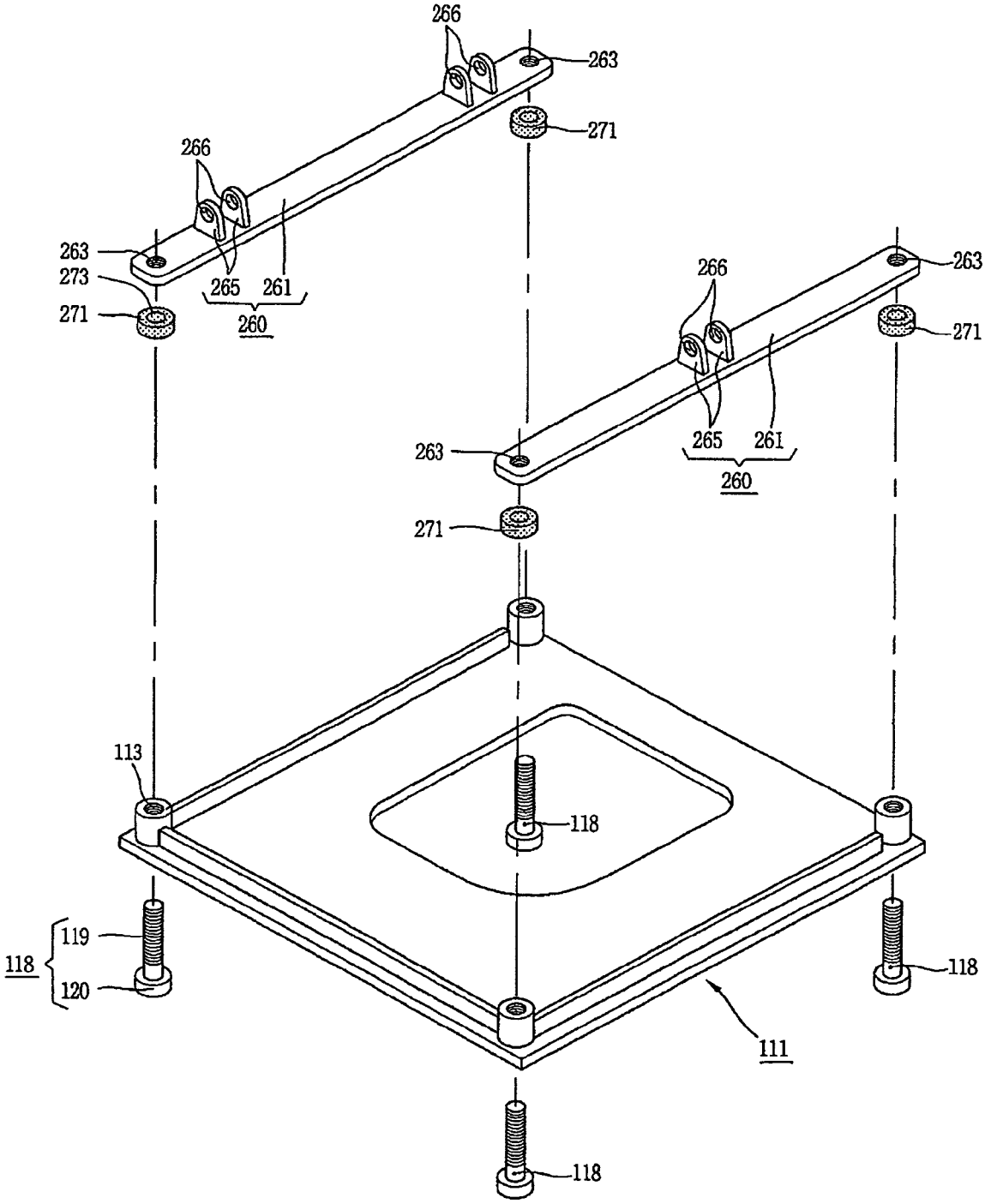
FIG. 7 is a perspective view showing a state prior to a coupling between a base and a damper-supporter of FIG. 6.
Figure 8:
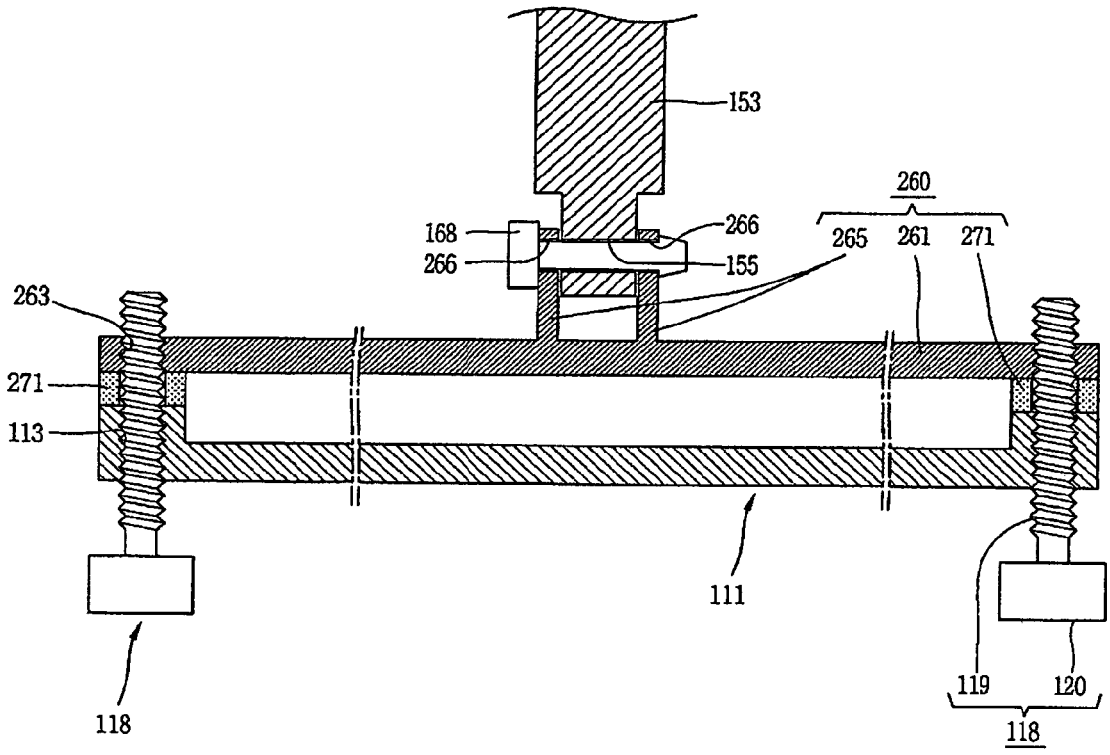
FIG. 8 is a sectional view showing a coupling state between the base and the damper-supporter of FIG. 7.

FIG. 6 is a sectional view showing a washing machine having a damper-supporter according to a second embodiment of the present invention, FIG. 7 is a perspective view showing a state prior to a coupling between a base and a damper-supporter of FIG. 6, and FIG. 8 is a sectional view showing a coupling state between the base and the damper-supporter of FIG. 7. The same reference numerals are given to the same parts as those of the aforementioned embodiment, and their minute explanation will be omitted. As shown, the washing machine having a damper-supporter according to a second embodiment of the present invention comprises an outer case 110 having a receiving space therein; a tub 130 installed in the outer case 110; a damper 153 having one end connected to the tub 130; and a damper-supporter 260 arranged to be vibration-isolated from the outer case 110 for supporting another end of the damper 153.

The damper-supporter 260 comprises a supporter 261 arranged inside the outer case 110 with a spacing distance from the outer case 110, and a damper connection portion 265 protruding from the supporter 261 and connected to the damper 153.

The supporter 261 is formed to have an intensity enough to support the tub 130 with consideration of a weight variation of the tub 130. The supporter 261 has a long plate shape so that both ends thereof can have a length enough to be coupled to the leg 118. A female screw portion 263 screw-coupled to the leg 118 is formed at both ends of the supporter 261. The damper connection portion 265 is constructed in two at one supporter 261, and is constructed in one at another supporter 261 in correspondence with the number and position of the damper 153. Each damper connection portion 265 is provided with a coupling hole 266 for coupling the coupling member 168.

A mount member 271 for supporting the supporter 261 with a spacing distance from the base 111 is provided between the supporter 261 and the base 111. The mount member 271 is formed of a rubber so as to prevent vibration from being transmitted between the supporter 261 and the base 111. A leg passing hole 273 for passing the leg 118 is formed in the middle of the mount member 271.

When the washing tub 140 is rotated during a washing operation, a rinsing operation, and a dehydrating operation, the tub 130 connected to the washing tub 140 is vibrated with a frequency corresponding to an rpm of the washing tub 140. Herein, the damper-supporter 260 prevent vibration of the damper 153 from being transmitted to the base 111 by a spring operation of the supporter 261 due to its own elasticity and an elastic force of the mount member 271. Accordingly, vibration and noise of the outer case 110 are reduced.

Figure 9:
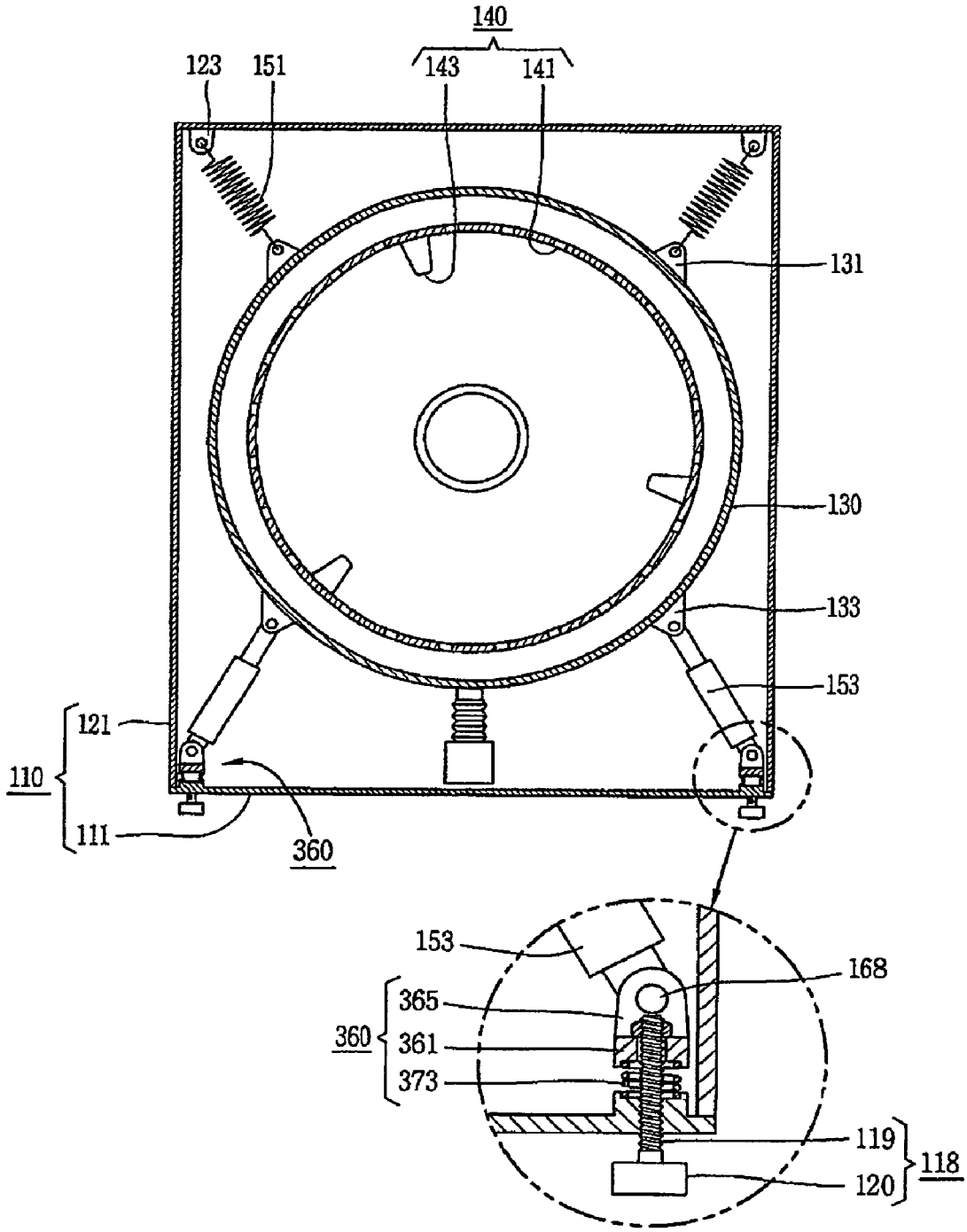
FIG. 9 is a sectional view showing a washing machine having a damper-supporter according to a third embodiment of the present invention.
Figure 10:
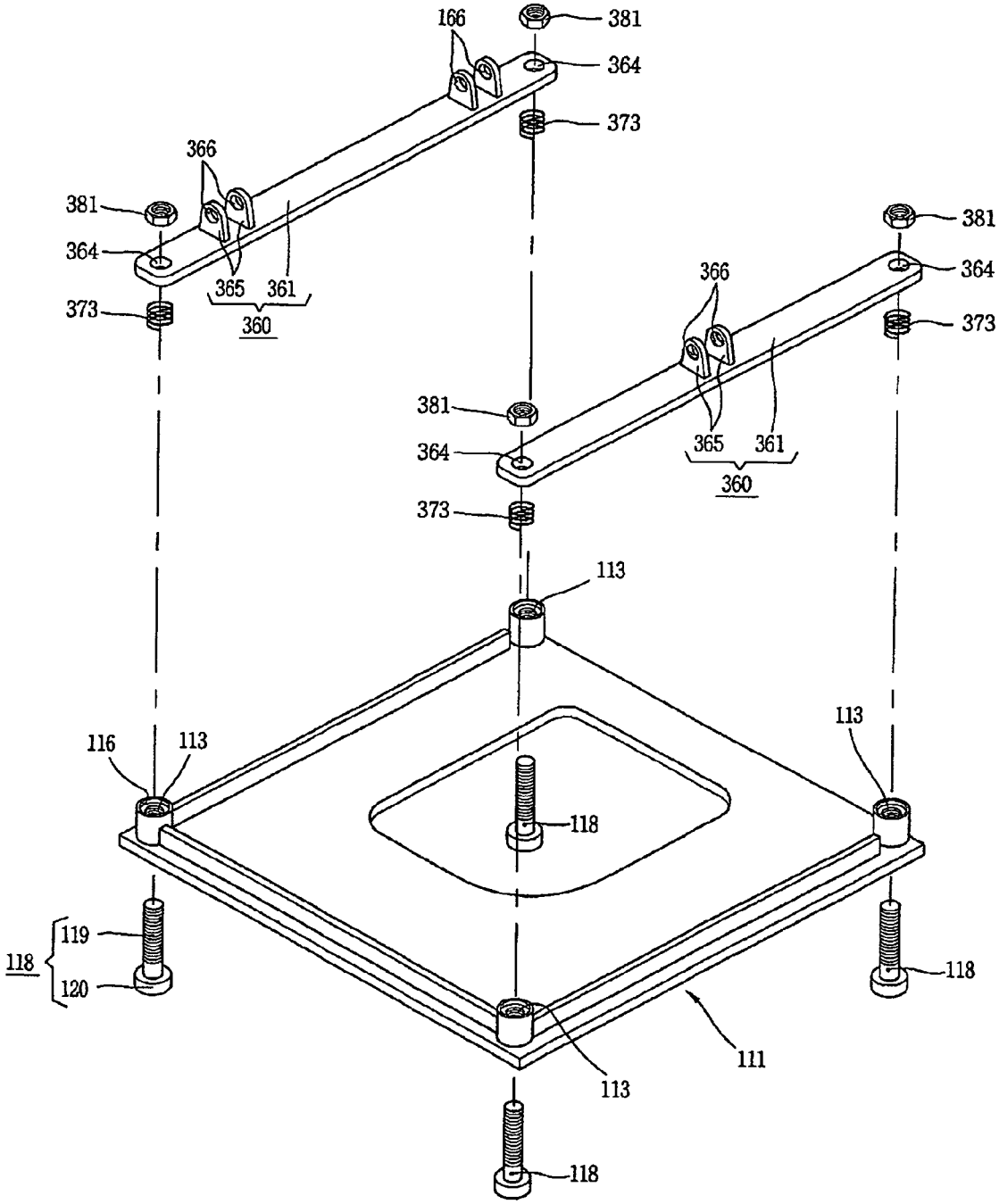
FIG. 10 is a perspective view showing a state prior to a coupling between a base and a damper-supporter of FIG. 9.
Figure 11:
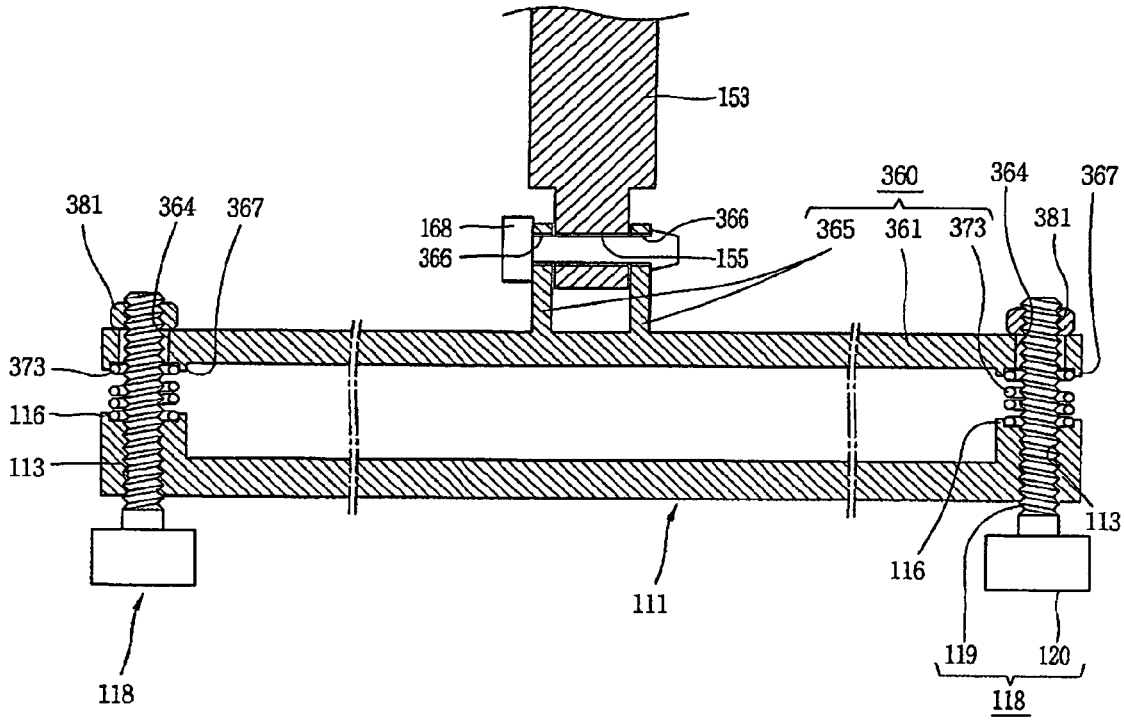
FIG. 11 is a sectional view showing a coupling state between the base and the damper-supporter of FIG. 10.

FIG. 9 is a sectional view showing a washing machine having a damper-supporter according to a third embodiment of the present invention, FIG. 10 is a perspective view showing a state prior to a coupling between a base and a damper-supporter of FIG. 9, and FIG. 11 is a sectional view showing a coupling state between the base and the damper-supporter of FIG. 10. As shown, the washing machine having a damper-supporter according to a third embodiment of the present invention comprises an outer case 110 having a receiving space therein; a tub 130 installed in the outer case 110; a damper 153 having one end connected to the tub 130; and a damper-supporter 360 arranged to be vibration-isolated from the outer case 110 for supporting another end of the damper 153.

The damper-supporter 360 comprises a supporter 361 arranged inside the outer case 110 with a spacing distance from the outer case 110, a damper connection portion 365 protruding from the supporter 361 and connected to the damper 153, and a spring 373 serving as a mount member for spacing the supporter 361 from the outer case 110 and supporting the supporter 361 so as to be vibration-isolated.

The supporter 361 is formed to have an intensity enough to support the tub 130 with consideration of a weight variation of the tub 130. The supporter 361 has a long plate shape so that both ends thereof can have a length enough to be coupled to the leg 118. A through hole 364 for passing the leg 118 is formed at both ends of the supporter 361. A nut 381 is coupled to an end of each leg 118 having inserted into through hole 364. The damper connection portion 365 is constructed in two at one supporter 361, and is constructed in one at another supporter 361 in correspondence with the number and position of the damper 153. Each damper connection portion 365 is provided with a coupling hole 366 for coupling the coupling member 168.

A spring 373 for supporting the supporter 361 with a spacing distance from the base 111 is provided between the supporter 361 and the base 111. The spring 373 is implemented as a compression coil spring that can be expanded and contracted in upper and lower directions. Also, spring inserting portions 116 and 367 for inserting upper and lower ends of the spring 373 are formed at the base 111 and the supporting plate 361, respectively.

When the washing tub 140 is rotated during a washing operation, a rinsing operation, and a dehydrating operation, the tub 130 connected to the washing tub 140 is vibrated with a frequency corresponding to an rpm of the washing tub 140. Herein, since the spring 373 prevents vibration of the supporting plate 361 connected to the damper 153 from being transmitted to the base 111, vibration and noise of the outer case 110 are reduced.

Figure 12:
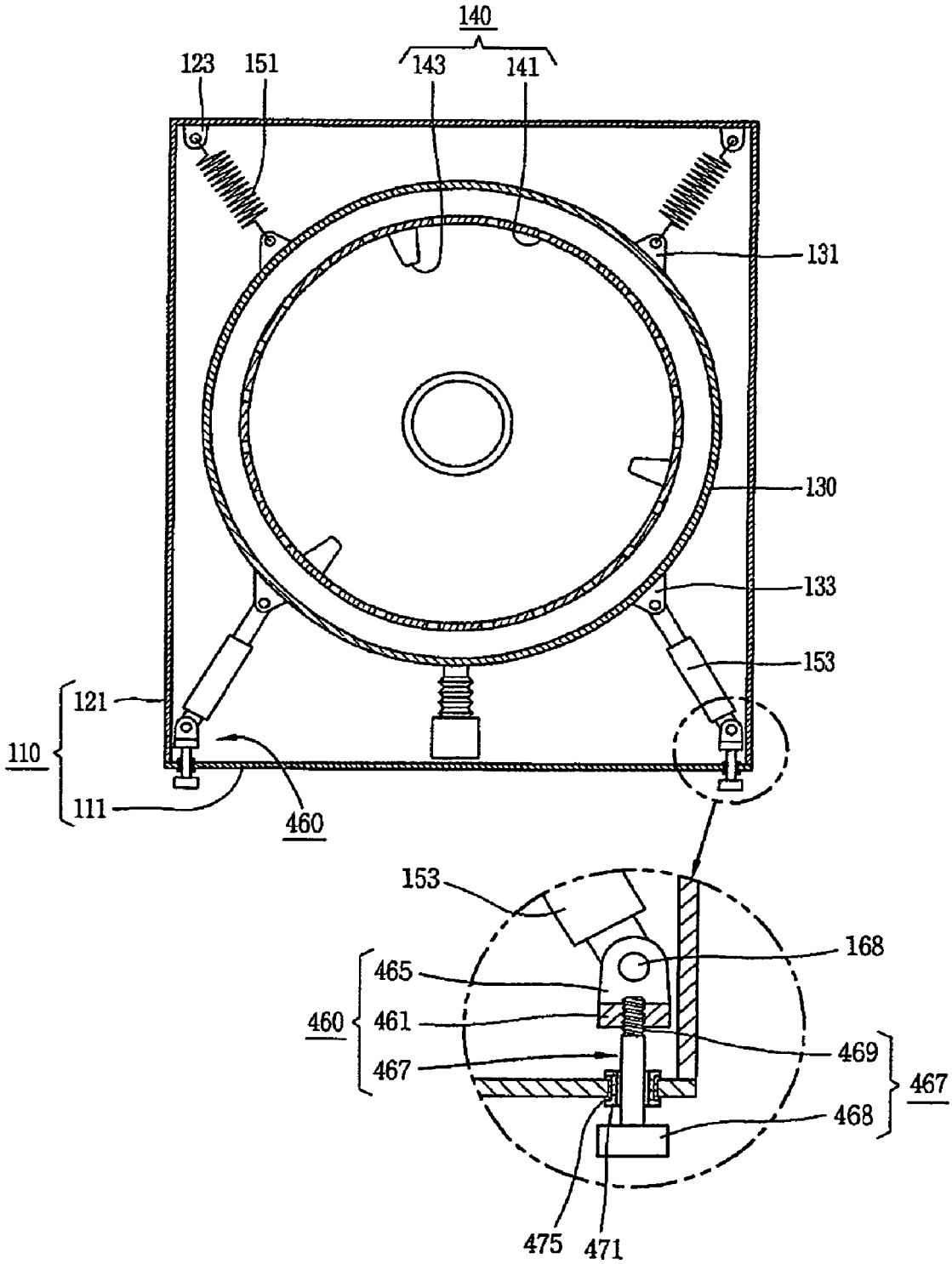
FIG. 12 is a sectional view showing a washing machine having a damper-supporter according to a fourth embodiment of the present invention.
Figure 13:
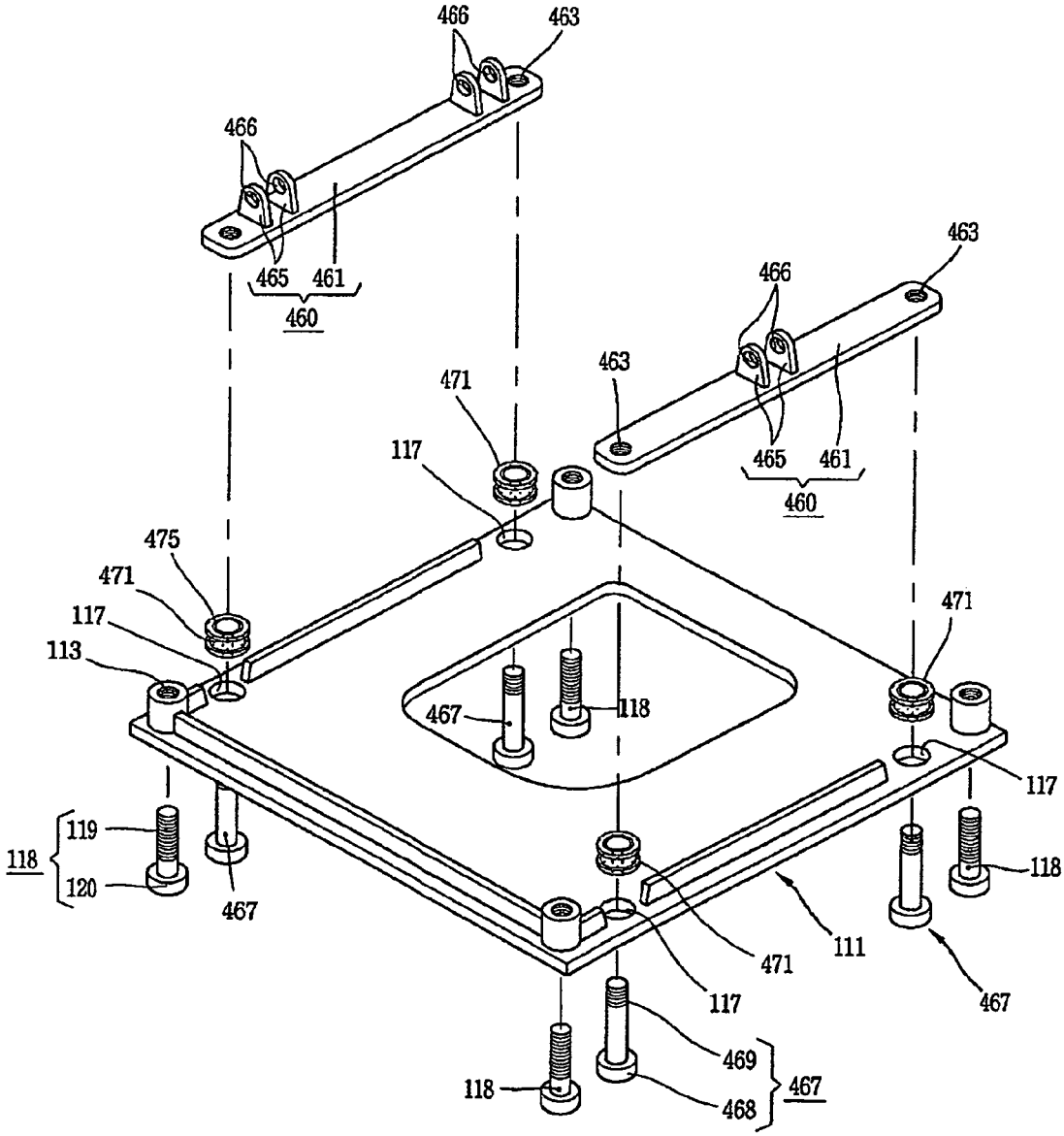
FIG. 13 is a perspective view showing a state prior to a coupling between a base and a damper-supporter of FIG. 12.
Figure 14:
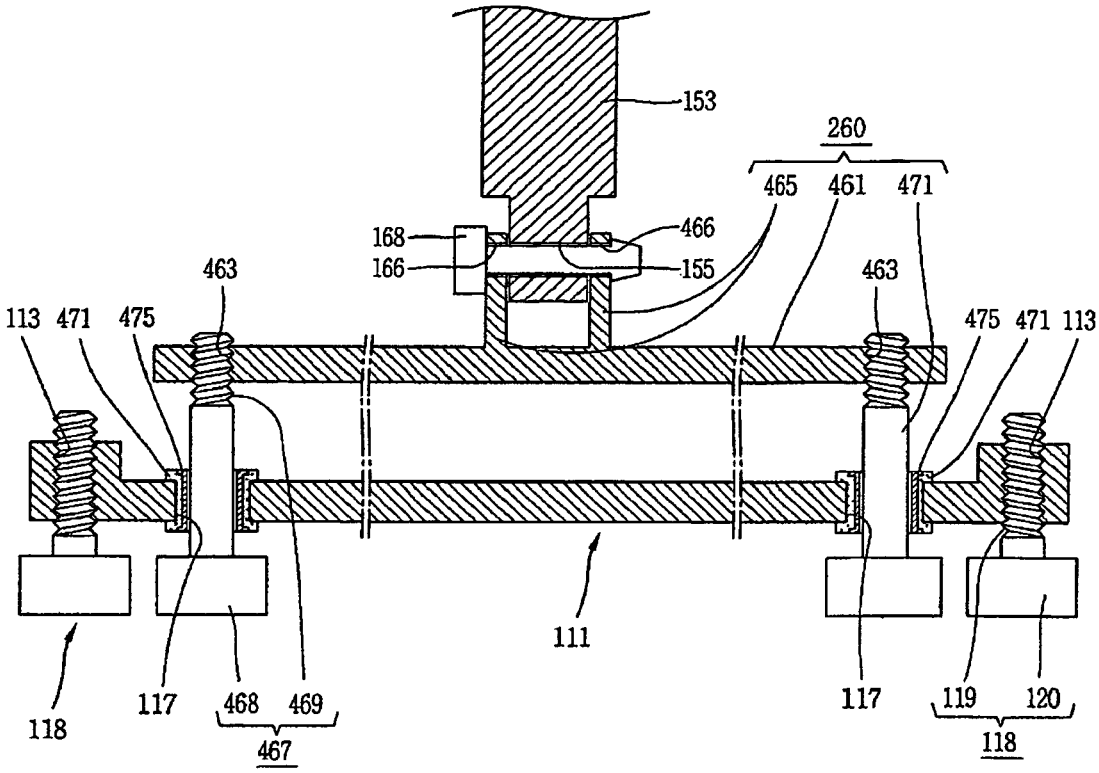
FIG. 14 is a sectional view showing a coupling state between the base and the damper-supporter of FIG. 13.

FIG. 12 is a sectional view showing a washing machine having a damper-supporter according to a fourth embodiment of the present invention, FIG. 13 is a perspective view showing a state prior to a coupling between a base and a damper-supporter of FIG. 12, and FIG. 14 is a sectional view showing a coupling-state between the base and the damper-supporter of FIG. 13.

As shown, a washing machine having a damper-supporter according to a fourth embodiment of the present invention comprises an outer case 110 having a receiving space therein; a tub 130 installed in the outer case 110; a damper 153 having one end connected to the tub 130; and a damper-supporter 460 arranged to be vibration-isolated from the outer case 110 for supporting another end of the damper 153.

The damper-supporter 460 comprises a supporter 461 arranged inside the outer case 110 with a spacing distance from the outer case 110, a damper connection portion 465 protruding from the supporter 461 and connected to the damper 153, and a leg portion 467 spaced from the outer case 110 for supporting the supporter 461 so as to be vibration-isolated.

The supporter 461 is formed to have an intensity enough to support the tub 130 with consideration of a weight variation of the tub 130. The supporter 461 has a long plate shape so that both ends thereof can have a length shorter than a length of the base 111 in back and forth directions. The damper connection portion 465 is constructed in two at one supporter 461, and is constructed in one at another supporter 461 in correspondence with the number and, position of the damper 153. Each damper connection portion 465 is provided with a coupling hole 466 for coupling the coupling member 168.

A leg portion 467 for supporting the supporter 461 with a spacing distance from the outer case 110 is downwardly extending at a lower portion of each supporter 461. Each leg portion 467 contacts the floor surface via the base 111. A male screw portion 469 screw-coupled to a female screw portion 463 formed at the leg portion 467 is formed at an upper end of the leg portion 467. A foot portion 468 formed of an elastic member such as a rubber, etc. is installed at a lower end of each leg portion 467 with consideration of a frictional force and a damping effect at the time of contacting the floor surface.

A leg hole 117 for passing the leg 467 is formed at the base, respectively. Each leg hole 117 is provided with a damping member 471 for preventing the leg portion 467 from colliding with an inner wall of the leg hole 117. The damping member 471 is formed of an elastic member such as a rubber member, and has a cylindrical shape. A bushing 475 formed of a synthetic resin, etc. and having a cylindrical shape is coupled to inside of the damping member 471. It is also possible to couple the bushing to the leg hole 117 and to insert the damping member into the bushing.

When the washing tub 140 is rotated during a washing operation, a rinsing operation, and a dehydrating operation, the tub 130 connected to the washing tub 140 is vibrated with a frequency corresponding to an rpm of the washing tub 140. Herein, since the supporter 461 and the leg portion 467 support the damper 153 so as to be vibration-isolated from the outer case 110, vibration of the damper 153 is prevented from being transmitted to the outer case 110. Accordingly, vibration and noise of the outer case 110 are reduced.

As aforementioned, in the washing machine having a damper-supporter of the present invention, the damper-supporter for supporting the damper is arranged so as to be vibration-isolated from the outer case. Accordingly, when the washing tub is rotated during a washing operation, a rinsing operation, and a dehydrating operation, vibration of the tub is prevented from being transmitted to the outer case. As the result, a reliability degradation and noise occurrence of the washing machine due to vibration of the outer case are prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A washing machine having a damper-supporter, comprising:

an outer case having a receiving space therein, the outer case including a base;

a tub installed in the outer case;

a damper having a first end directly coupled to the tub so as to perform a relative motion thereby to reduce the vibration of the tub;

a plurality of legs for controlling a height of the outer case directly coupled to a lower portion of the base; and a damper-supporter supporting a second end of the damper, the damper-supporter comprising:

a supporter having a long plate shape offset from the base by at least one mount member interposed between the supporter and the base, wherein the outer case is substantially isolated from vibrations of the supporter by the mount member; and a damper connection portion protruding from the supporter and coupled to the damper; wherein both ends of the supporter are directly coupled to the plurality of legs and the legs rest on a floor where the washing machine is laid so as to make the vibration of the supporter supported by the floor, wherein the mount member is formed of an elastic member so as to prevent vibration from being transmitted between the supporter and the base.

2. The washing machine of claim 1, wherein the supporter is arranged along an outside surface of the base.

3. The washing machine of claim 2, wherein the supporter is arranged below the base of the outer case, and wherein a through hole adapted to receive the damper connection portion is formed at a lower portion of the base, wherein the damper connection portions do not contact the base.

4. The washing machine of claim 1, wherein the supporter is arranged along an inside surface of the base.

5. The washing machine of claim 1, wherein the mount member is formed of a rubber member.

6. The washing machine of claim 1, wherein the mount member is formed of a spring member.

* * * * *